US009987534B2

(12) United States Patent
Akin et al.

(10) Patent No.: US 9,987,534 B2
(45) Date of Patent: Jun. 5, 2018

(54) GRIP ALIGNMENT TRAINING AID

(71) Applicant: Re-Peat Sports, LLC, Pleasant Hill, MO (US)

(72) Inventors: Tim Akin, Pleasant Hill, MO (US); Matthew W. Mitchell, Harrisonville, MO (US)

(73) Assignee: RE-PEAT SPORTS, LLC, Pleasant Hill, MO (US)

( * ) Notice: Subject to any disclaimer, the term of this patent is extended or adjusted under 35 U.S.C. 154(b) by 0 days. days.

(21) Appl. No.: 15/297,597

(22) Filed: Oct. 19, 2016

(65) Prior Publication Data

US 2017/0106260 A1 Apr. 20, 2017

Related U.S. Application Data

(60) Provisional application No. 62/243,498, filed on Oct. 19, 2015.

(51) Int. Cl.
*A63B 60/00* (2015.01)

(52) U.S. Cl.
CPC ..... *A63B 60/00* (2015.10)

(58) Field of Classification Search
CPC ..... A63B 60/00
See application file for complete search history.

(56) References Cited

U.S. PATENT DOCUMENTS

| | | | | |
|---|---|---|---|---|
| 1,587,287 | A * | 6/1926 | Denman | A63B 53/14 473/205 |
| 4,752,075 | A * | 6/1988 | Bencriscutto | A63B 69/3608 473/205 |
| 5,184,815 | A | 2/1993 | Maddox | |
| 5,601,285 | A | 2/1997 | Baxter, III | |
| 6,389,596 | B2 | 5/2002 | Lomedico | |
| 8,052,546 | B1 | 11/2011 | Nagel et al. | |
| 2013/0281902 | A1 | 10/2013 | McCrae | |

* cited by examiner

*Primary Examiner* — Michael Dennis
(74) *Attorney, Agent, or Firm* — Husch Blackwell LLP

(57) ABSTRACT

A training device for use with sporting equipment, such as bats and clubs, is provided. The device can include a main body defined by a perimeter sidewall and can include two openings defined through the body. The perimeter sidewall can have rounded end regions and flattened top and bottom regions and can be sized to accommodate two openings large enough to receive a user's fingers. The device can be used by inserting the index finger on one hand through the bottom opening and the little finger of the opposing hand through the upper opening. The user can then align the user's knuckles to the desired grip and grip the bat or club handle. The device can then assist the user in maintaining the proper grip of the bat or club handle while holding and swinging the bat or club.

11 Claims, 9 Drawing Sheets

GRIP ALIGNMENT TRAINING AID

CROSS-REFERENCE TO RELATED APPLICATIONS

This Application claims priority to U.S. Provisional Patent Application Ser. No. 62/243,498, filed on Oct. 19, 2015, to Tim Akin et al., entitled "Grip Alignment Training Aid," the entire disclosure of which is incorporated herein by reference.

FIELD OF THE INVENTION

The present invention generally relates to training and support aids for sporting activities, including baseball, softball, golf, tennis, hockey and other athletic activities. In particular, the present invention relates to a grip alignment device for assisting with the proper hand alignment while gripping a baseball bat, golf club or similar sporting equipment and/or for providing hand support while swinging a baseball bat, golf club or similar sporting equipment.

BACKGROUND OF THE INVENTION

Training devices for baseball, golf and other sports have previously been developed for assisting proper grip alignment of a user's hands relative to a baseball bat or golf club. One such device is disclosed in U.S. Pat. No. 5,184,815 to Maddox and incorporates batting gloves that have alignment indicators located on the exterior portions of the gloves. These alignment indicators are positioned along the fingers of the gloves and provide visual verification when a user properly grips the bat. However, this device does not effectively restrict a user from improperly positioning or moving his or her hands during the baseball or golf swing. Other devices incorporate various structures that are secured or connected to the bat or club and guide or restrict placement of the user's hands while griping the bat or club. While these devices assist in proper positioning of a user's hands relative to the bat or club, they are not easily removable, can be uncomfortable, and are specific to the particular bat or club rather than the user. Accordingly, a need exists for a grip alignment device that aids in proper positioning of a user's hands relative to the baseball bat or golf club (or similar sporting equipment). Additionally, a need exists for such a device that effectively maintains the user's hands in proper position during the swing of the baseball bat or golf club. Further, a need also exists for such a device that is comfortable, conforming and does not inhibit the user's feel of the baseball bat or golf club, and is easily removable, small, and lightweight.

SUMMARY OF THE INVENTION

The present invention is directed to a grip alignment training device that can be used to assist a user in maintaining the proper grip alignment of a baseball or softball bat, golf club or other similar sporting equipment. The device can also function as a support aid device by reducing stress or pain resulting from swinging the bat or golf club.

The training device can be configured with a main body portion defined by an exterior sidewall having flattened top and bottom sidewall regions and generally rounded end sidewall regions. The exterior sidewall can alternatively have any number of different shapes and configurations depending on the particular embodiment of the device. Defined through the main body can be two openings that are sized and configured for receiving fingers of a user of the device. The two openings can generally conform to the rounded shape of the sidewall end regions and can be separated within the main body portion by a dividing wall.

In order to accommodate a user's hands while the device is being used to assist in gripping a bat or club, one of the flattened sidewall regions can have a reduced thickness and/or reduced width relative to the opposing flattened sidewall region. The reduced width of this flattened sidewall region can be formed by the creation of tapered edges along the sides of the end sidewall regions so that the width of the exterior sidewall gradually increases as the end sidewall regions extend from the narrowed flattened part of the sidewall to the widened flattened part of the sidewall.

The device can be used as a training or support aid by inserting the user's bottom hand index finger into lower opening of the device such that device is positioned between the first and second knuckles on the index finger and the narrowed sidewall region is positioned adjacent to the interior of the user's bottom hand. The user may then insert the user's top hand little finger or third finger through the adjacent opening in the device until the user's knuckles are properly aligned. The user can then grip the bat handle or golf club handle (or other similar sporting equipment) with the device connecting the user's hands together and providing the proper alignment of the user's hand while holding and/or bat or club.

Other aspects and advantages of the present invention will be apparent from the following detailed description of the preferred embodiments of the accompanying drawings figures.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

DETAILED DESCRIPTION OF THE INVENTION

Figure 1:
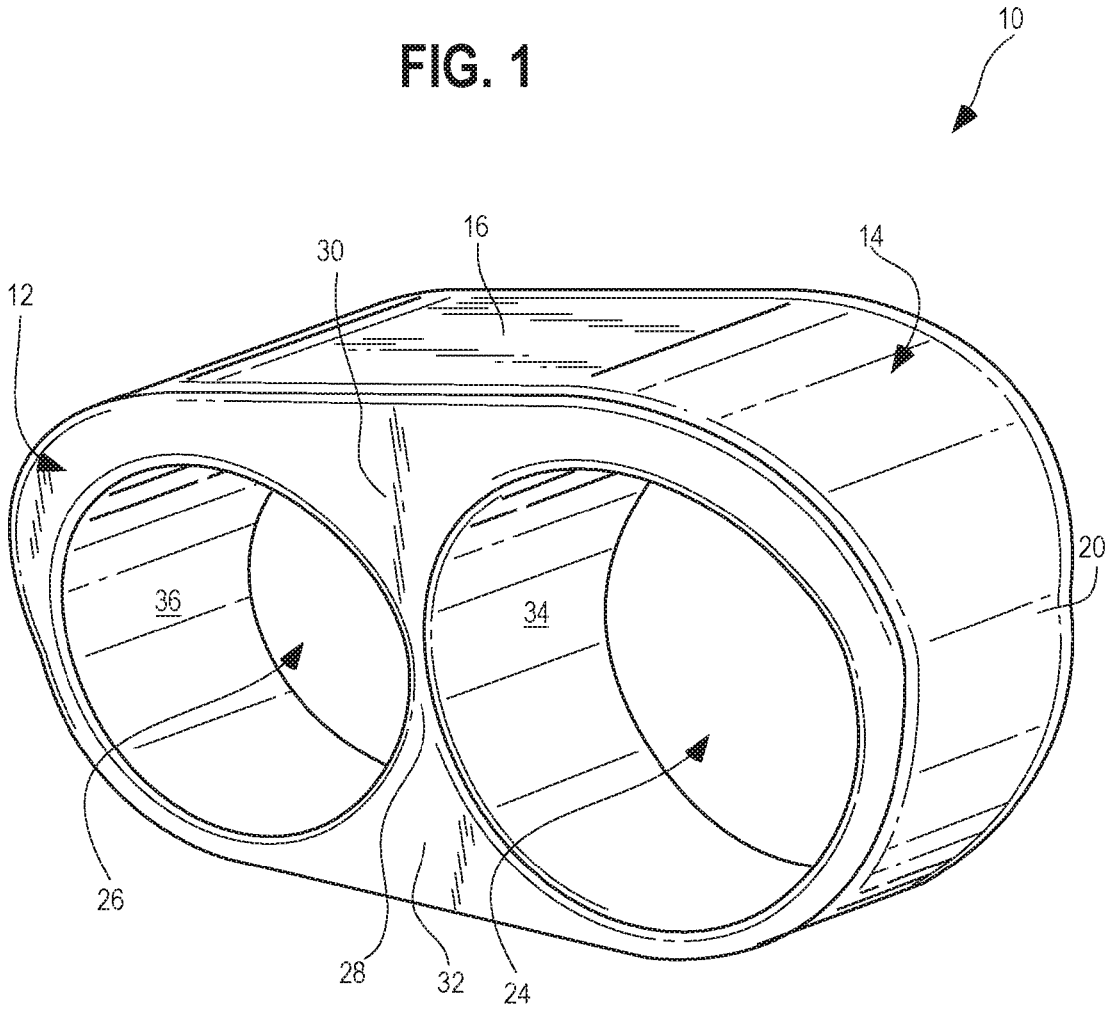
FIG. 1 is a perspective view of a grip alignment training device in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

The present invention is directed generally to a grip alignment training device 10 for use when gripping and swinging a baseball or softball bat or golf club. Device 10 can also be used in any number of different sporting activities where a piece of sporting equipment similar to a bat or club is used in a similar manner, such as for example, a tennis racket or hockey stick. It is well known that proper positioning of a user's hands relative to a baseball bat or golf club is important for correct and optimal swinging of the baseball bat or golf club. Many athletes, and in particular, youth athletes, struggle to maintain proper grip alignment, not only before, but during the swing of the baseball bat or golf club. Device 10 can be used to aid or assist the user in maintaining proper grip alignment when swinging the bat or club by limiting movement or rotation of the user's hands relative to one another during the his or her swing. As a result, device 10 can train the user to utilize a proper grip alignment. Device 10 can also be used as a support device when swinging a baseball bat or golf club. For example, a user may use device 10 to support sore or arthritic hands while swinging a golf club. By preventing the user's hands from rotating or moving improperly, device 10 can reduce the stress and forces applied to the user's hands, thereby acting as a support device.

Figure 2:
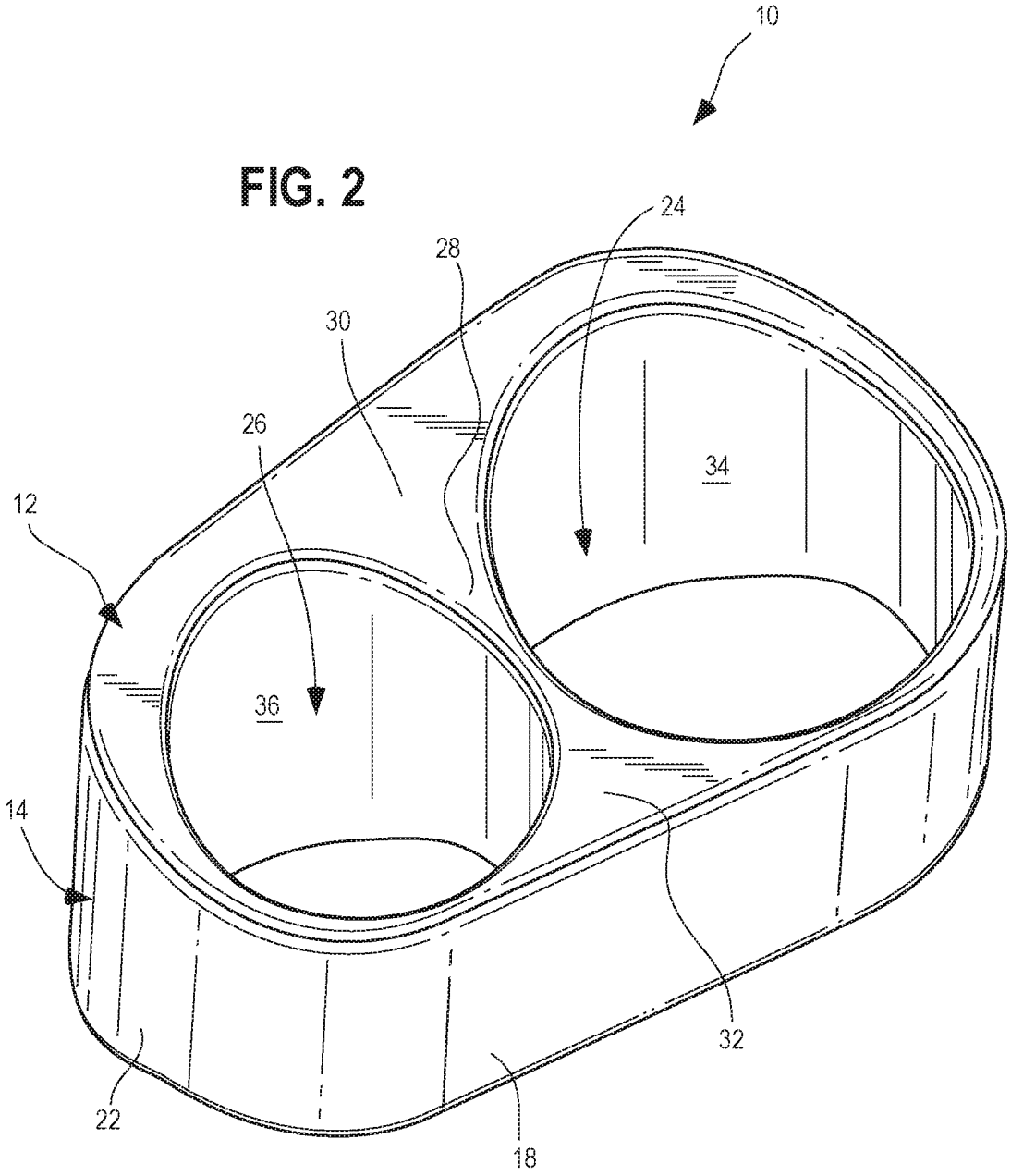
FIG. 2 is a perspective view of the grip alignment training device of FIG. 1.

Turning to the figures, device 10 can comprise a main body portion 12 defined by a perimeter outer sidewall 14, as best shown in FIGS. 1 and 2. Perimeter sidewall 14 can include a plurality of sidewall regions 16-22 that can define the shape and structure of device 10. Device 10 can further include a first opening 24 and a second opening 26, each defined transversely through main body portion 12. As illustrated in FIGS. 1 and 2, openings 24 and 26 can extend fully through main body portion 12 and can be separated from one another by a dividing wall region 28. As described in greater detail below, first and second openings 24 and 26 can be configured to receive the user's fingers so that device 10 can be used to assist in proper grip alignment of the user's hands when using a bat or club or other sporting equipment.

Figure 3:
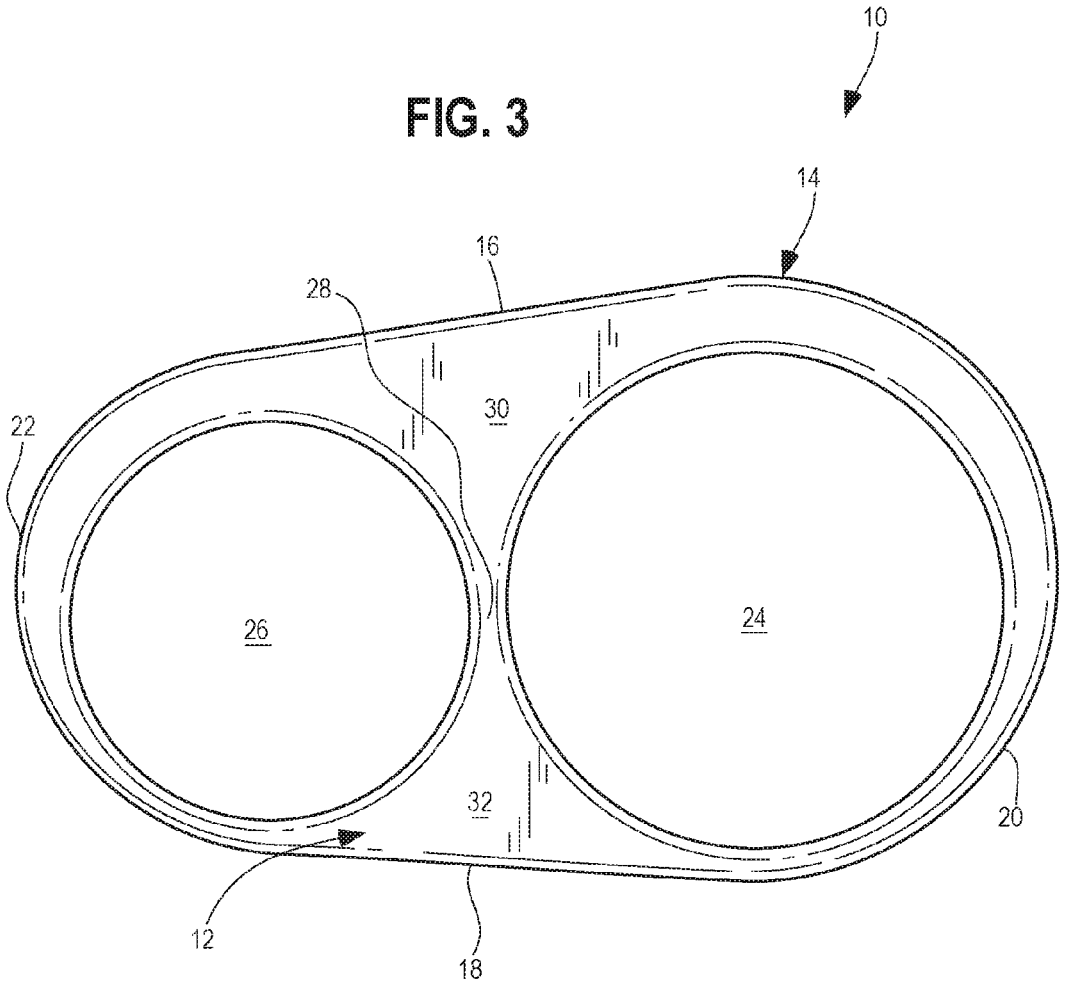
FIG. 3 is a plan view of the grip alignment training device of FIG. 1.
Figure 9:
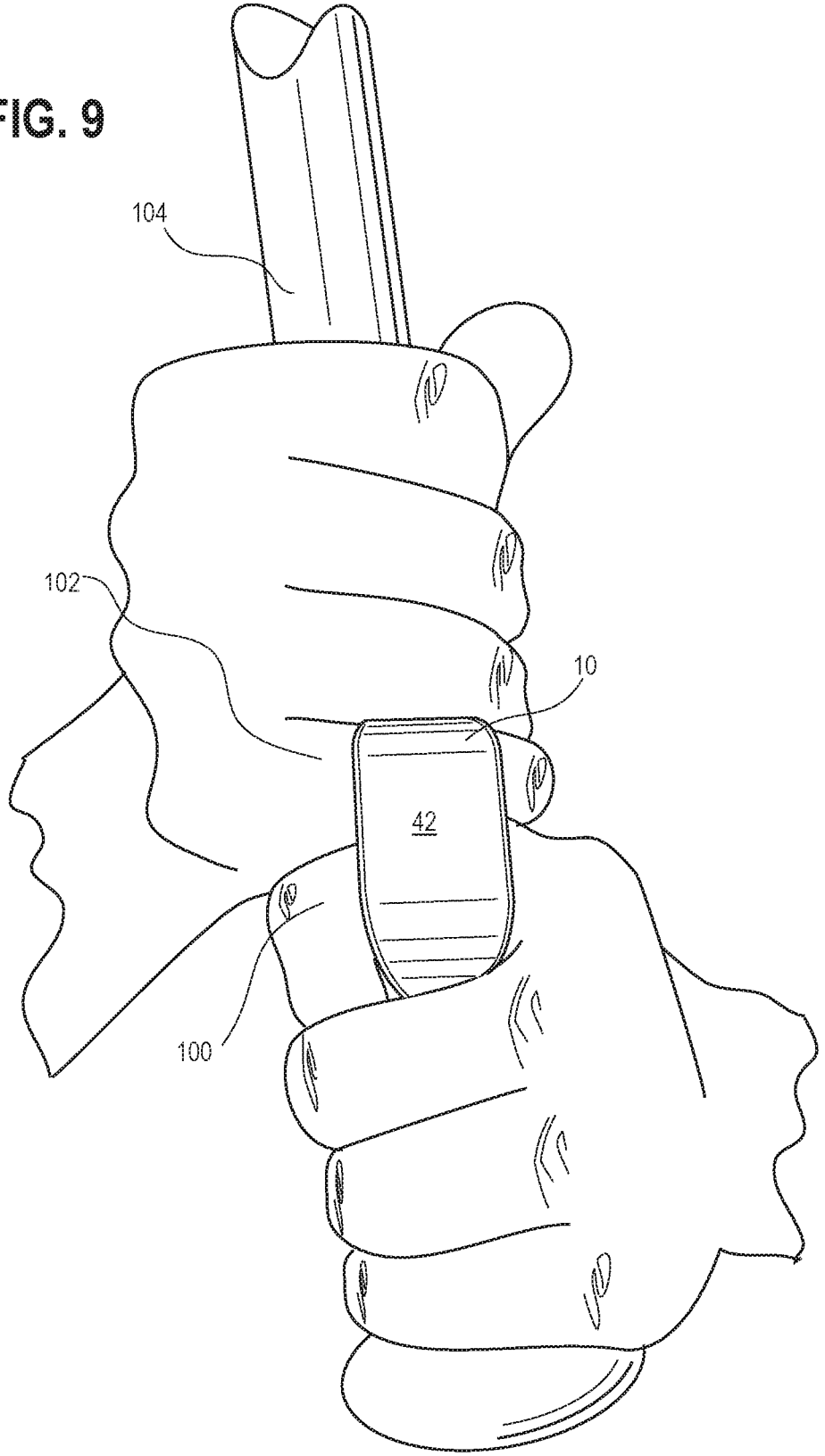
FIG. 9 is a perspective view of a grip alignment training device positioned within a user's hands and being used by the user for proper grip alignment of a baseball bat in accordance with one embodiment of the present invention.

FIGS. 1-3 collectively illustrate the shape and configuration of device 10, defined by perimeter sidewall 14, according to one embodiment of the present invention. As shown in the figures, perimeter sidewall 14 can include a top sidewall region 16, a bottom sidewall region 18 and end sidewall regions 20 and 22. It is recognized that the identifiers "top," "bottom," and "end" sidewall regions are used for identification and exemplary purposes only and are not intended to restrict the orientation or configuration of device 10. According to one embodiment of the present invention, bottom sidewall region 18 can have a generally flattened shape in order to allow region 18 (and device 10) to be positioned comfortably against the bat or club (or other sporting equipment device) when gripped by a user using device 10. As described in greater detail below, device 10 can be configured for bottom sidewall region 18 to be positioned adjacent to and face inward toward the handle portion of the bat or club when the user is using device 10. As a result, bottom sidewall region 18 can be configured with a flattened shape in order to allow bottom sidewall 18 to contact the handle portion of the bat or club without obstructing the user's grip. Top sidewall region 16 can similarly have a generally flattened shape as illustrated in the several figures; however, it is recognized that top sidewall region 16 can alternatively have any number of different configurations so long as it does not adversely affect the user's use of device 10 in connection with a bat or club or other sporting equipment. For example, because top sidewall region 16 can be configured for placement on the outer side of the user's hands (as shown in FIG. 9), top sidewall region 16 can have a rounded shape or can include padding and/or additional support structures in certain embodiments of the present invention.

In addition, as best shown in FIG. 3, bottom sidewall 18 can have a reduced thickness relative to top sidewall region 16 in order to allow device 10 to rest snuggly against the bat or club and to prevent device 10 from obstructing the user's grip of the bat or club. The reduced thickness of bottom sidewall region 18 can allow for a better conforming and comfortable fit between device 10, the bat or club handle and the user's hands by minimizing the space between the handle and the user's hands. According to this particular embodiment, top sidewall 16 can have an increased thickness relative to bottom sidewall 18, which can increase the structural rigidity and strength of device 10. According to one particular embodiment of the present invention, top sidewall region 16 can have a thickness of approximately ⅛ inches and bottom sidewall region 18 can have a thickness of approximately 1/16 inches.

As illustrated in the figures, end sidewall regions 20 and 22 can extend between top and bottom sidewall regions 16 and 18 and have a generally rounded or curved shape. The rounded or curved shape can allow device 10 to comfortably fit in the user's hands when device 10 is being used with the bat or club. The rounded or curved shape of end sidewall regions 20 and 22 can additionally allow device 10 to generally conform to the minor shifting and rotation of a user's hands while swinging the bat or club. In addition, as best illustrated in FIG. 3, the thickness of end sidewall regions 20 and 22 can gradually increase as end sidewall regions 20 and 22 extend from bottom sidewall region 18 to top sidewall region 16.

Dividing wall region 28 can extend between top and bottom sidewall regions 16 and 18 within the interior of main body portion 12 of device 10. As shown in FIGS. 1-3, dividing wall region 28 can act as a spacer or divider between first and second openings 20 and 22. For example, dividing wall region 28 can be configured to provide proper spacing between openings 24 and 26 so that a user's fingers and hands are advantageously and accurately spaced apart when using device 10 as described in greater detail below. Dividing wall region 28 can also include thickened regions 30 and 32 that can be created by the shape of openings 20 and 22 relative to one another and main body portion 12. Thickened regions 30 and 32 can function to increase the structural rigidity and strength of device 10 and allow device 10 to sufficiently maintain its shape when in use. Thickened regions 30 and 32 can further allow perimeter sidewall 14 to have a reduced thickness due to the additional structural support provided by thickened regions 30 and 32 to main body portion 12.

FIGS. 1-3 illustrate first and second openings 24 and 26 relative to main body portion 12 of device 10. As best shown in FIG. 1, openings 24 and 26 can have a generally circular cross-section defined by an inner sidewall 34 or 36, respectively. While it is recognized that openings 24 and 26 can have any number of suitable cross-sectional shapes in alternative embodiments of device 10, a generally circular cross-sectional shape can provide a configuration that generally allows the user's fingers to be comfortably received within openings 24 and 26. As shown in FIGS. 1-3, inner sidewalls 34 and 36 can extend through main body portion 12 in a generally perpendicular manner so that the cross-section of openings 24 and 26 is the same size on both sides of main body portion 12 according to one embodiment of the present invention. In an alternative embodiment, inner sidewalls 34 and 36 can extend through main body portion 12 with a slightly angled orientation such that the cross-section of opening 24 or 26 on one side of main body portion 12 is slightly larger than the cross-section of the same opening 24 or 26 on the other side of main body portion 12. This configuration can be intended to generally mirror the narrowing contours of a user's finger so that device 10 has more of a conforming fit when in use by the user. As explained in greater detail below, first opening 24 can be preferably designed to receive the user's index finger on one hand while second opening 26 can be preferably designed to receive the user's little finger or third finger on the other hand. As a result, first opening 24 can be configured with a larger cross-sectional area than second opening 26, as best shown in FIG. 3. Additionally, openings 24 and 26 can be strategically spaced apart (via dividing wall 28) so that the user's index finger (and hand) is properly aligned and spaced from the user's opposing little or third finger (and opposing hand).

As also best illustrated in FIG. 3, top sidewall region 16 can have a slightly angled configuration relative to bottom sidewall region 18 according to one embodiment of the present invention. As described above, first opening 24 can be configured with a slightly larger cross-section than that of second opening 26. As a result, in order to provide a generally consistent thickness of top sidewall region 16 along its entire length, sidewall region 16 can be configured to conform to the different cross-sections of openings 24 and 26. In alternative embodiments, top sidewall region 16 can have a non-equal or non-uniform thickness and can be generally parallel relative to bottom sidewall region 18 or can have any desired orientation relative to bottom sidewall region 18.

Device 10 can also be configured with additional openings in alternative embodiments of the present invention (not shown). Such additional openings (not shown) can be designed to receive additional fingers on either of the user's hands. For example, in one alternative embodiment, device 10 can be configured with a third opening (not shown) adjacent to opening 26. This opening (not shown) can be designed and sized in a similar manner to openings 24 and 26 described above. In this alternative embodiment (not shown), openings 24 and 26 and the additional opening can be configured to receive the user's index finger on one hand and the user's little finger and third finger on the other hand, or the user's index finger and middle finger on one hand and the user's little finger or third finger on the other hand.

Figure 4:
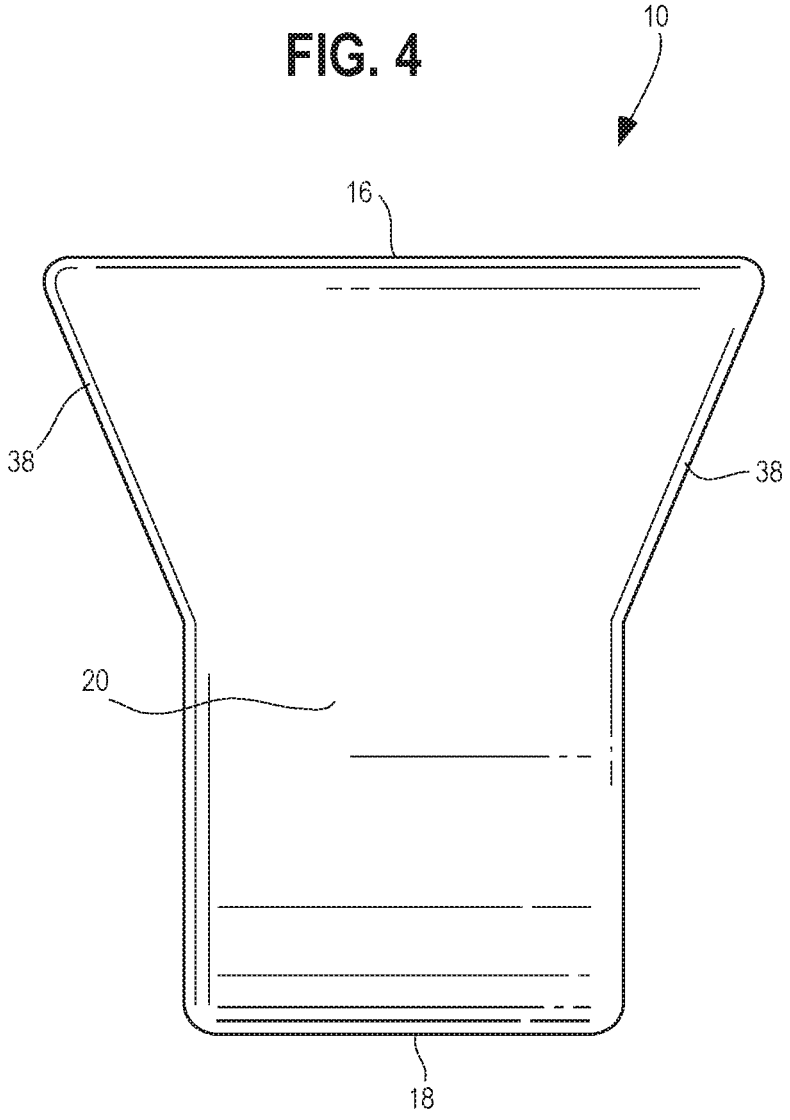
FIG. 4 is a side elevation view of the grip alignment training device of FIG. 1.
Figure 5:
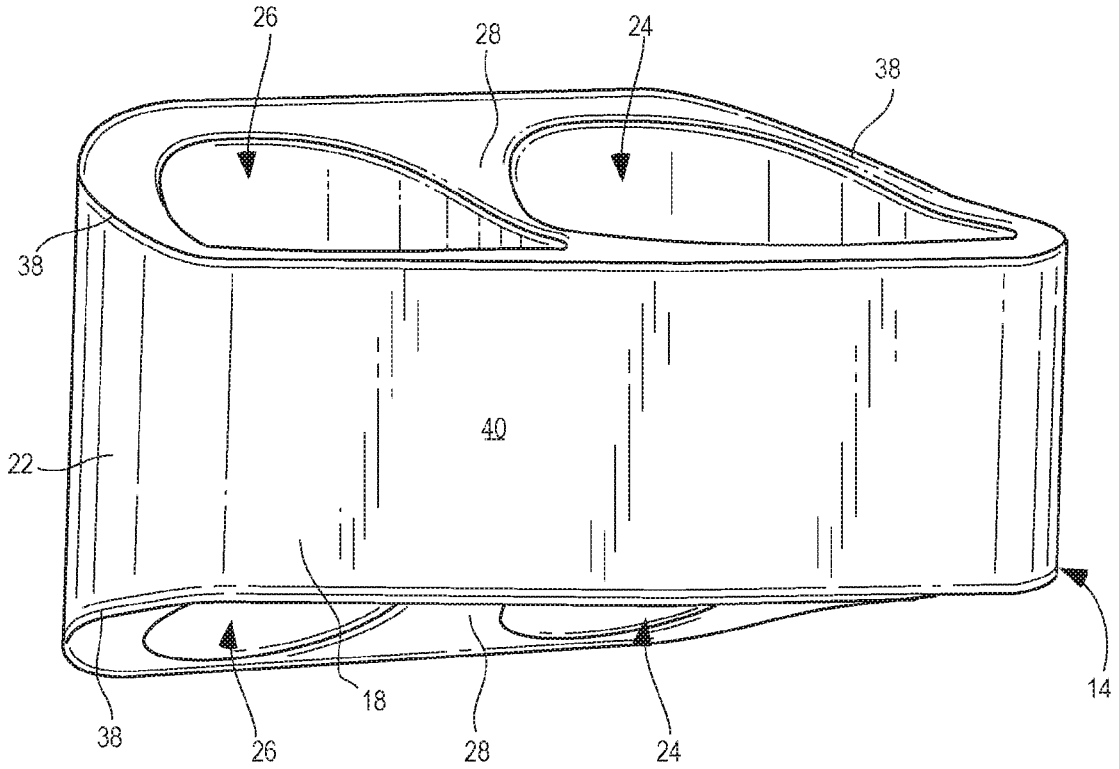
FIG. 5 is a perspective view of the grip alignment training device of FIG. 1.
Figure 6:
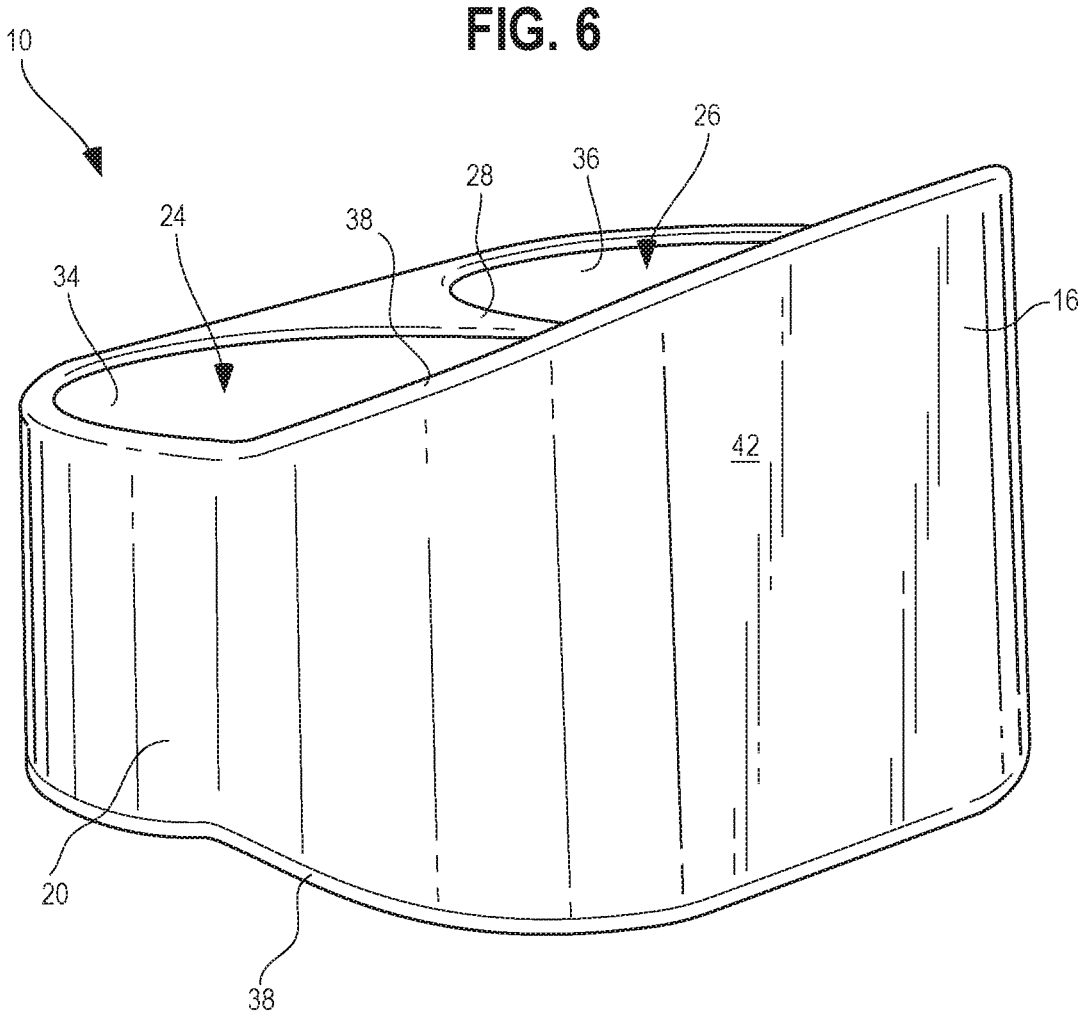
FIG. 6 is a perspective view of the grip alignment training device of FIG. 1.

Turning now to FIGS. 4-6, perimeter sidewall 14 can include a tapered configuration that can allow device 10 to fit more comfortably and conformingly with the user's hands and fingers when device 10 is in use. As described in greater detail below, bottom sidewall region 18 can be configured to rest between the bat or club handle and the user's hands when device 10 is in use. The reduced width of bottom sidewall region 18 can allow the user to better grip the bat or club handle without obstruction from device 10. As shown in FIGS. 4-6, the width of top sidewall region 16 can be greater than the width of bottom sidewall region 18. In such a configuration, the width of surface 40 of bottom sidewall region 18 (as shown in FIG. 5) can be less than the width of surface 42 of top sidewall region 16 (as shown in FIG. 6). The difference in width between top and bottom sidewall regions 16 and 18 can be gradually created by configuring tapered edges 38 on one or both edges of end sidewall regions 20 and 22. As shown in the figures, end sidewall regions 20 and 22 can have tapered edges on both sides; however, in alternative embodiments, end sidewall regions 20 and 22 can have a tapered edge 38 on only one side. In addition, tapered edges 38, as shown in FIGS. 4-6, extend only approximately half-way along the length of end sidewall regions 20 and 22; however, tapered edges 38 can alternatively extend less than half-way, greater than half-way or the entire length of end sidewall regions 20 and 22 in alternative embodiments of the present invention. Device 10 can also be configured without any tapered edges 38 in other alternative embodiments of the present invention.

Tapered edges 38 can be configured to generally conform to the manner in which a person's fingers fold when gripping a bat or club handle. For example, when a person's hand is gripped around a handle, the folds of the person's fingers, between the first and second knuckle form a general "v" shape. Accordingly, tapered edges 38 (and end sidewall regions 20 and 22) can be configured to generally conform to this orientation of the user's hands and fingers. This can allow for the user to obtain a better conforming grip around the club or bat while using device 10. Tapered edges 38 can also allow for the gradual reduction of width of perimeter sidewall 14 between top sidewall region 16 and bottom sidewall region 18. The reduced width of bottom sidewall region 18 can allow for a better fit between device 10, the user's hands and the handle portion of the bat or club. Region 16 can have a greater width to provide increased structural rigidity and strength of device 10 when in use by the user.

Figure 7:
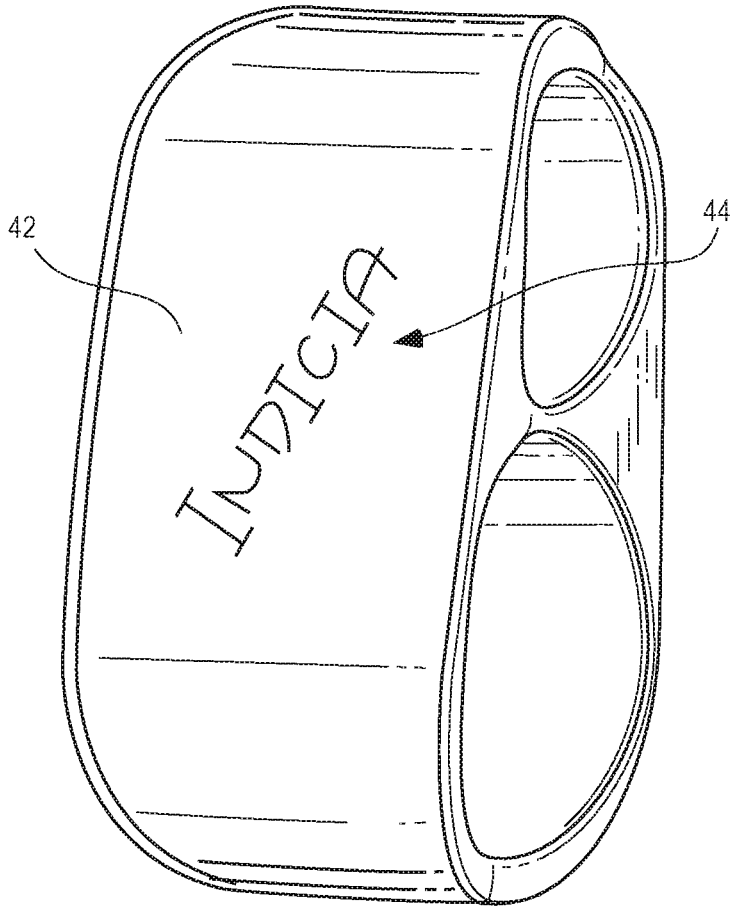
FIG. 7 is a perspective view of a grip alignment training device having indicia printed thereon in accordance with one embodiment of the present invention.

As illustrated in FIG. 7, device 10 can also have indicia 44 printed, etched or otherwise provided thereon. Indicia 44 can comprise a design, logo, advertising, team name, I.D. information or other indicia. As shown in FIG. 7, indicia 44 can be placed on surface 42 of top sidewall region 16 so that indicia 44 faces outward when device 10 is being used by the user. Indicia 44 can additionally or alternatively be placed on any other suitable or desired location on device 10.

The foregoing description is merely exemplary of only a few of the possible configurations and arrangements of main body portion 12 and perimeter sidewall 14 (including regions 16-22). Accordingly, it is recognized that main body portion 12 and perimeter sidewall 14 can be designed in alternative shapes in certain embodiments while still providing the proper grip alignment features described below.

As described above, device 10 is intended to facilitate maintaining proper alignment of a user's hands when gripping and using a baseball bat, golf club, or similar device. For example, when gripping a baseball (or softball) bat, it is commonly taught to use either a "knocking knuckle" grip or a "box" grip. With the knocking knuckle grip, the second row of knuckles of a user's top and bottom hands are generally aligned longitudinally while wrapped around the bat. With a box grip, the second row of knuckles of the user's bottom hand is longitudinally aligned with the first row of knuckles of the user's top hand. A combination of these grips is also commonly used, where the second row of knuckles of the user's top hand is positioned between the first and second rows of knuckles of the user's second hand. Similarly, when gripping a golf club, it is commonly taught to use a neutral grip, overlapping grip or interlocking grip. In each of these golfing grips, the second rows of knuckles for both hands are generally aligned, similar to a knocking knuckle grip in baseball. Device 10 can be used to require proper alignment of a user's hands when gripping a baseball bat or golf club by restricting the user's hands within the proper knuckle alignment. Thus, device 10 can be designed to limit the user to positioning their hands in accordance with any of the above-described grip alignments.

Figure 8:
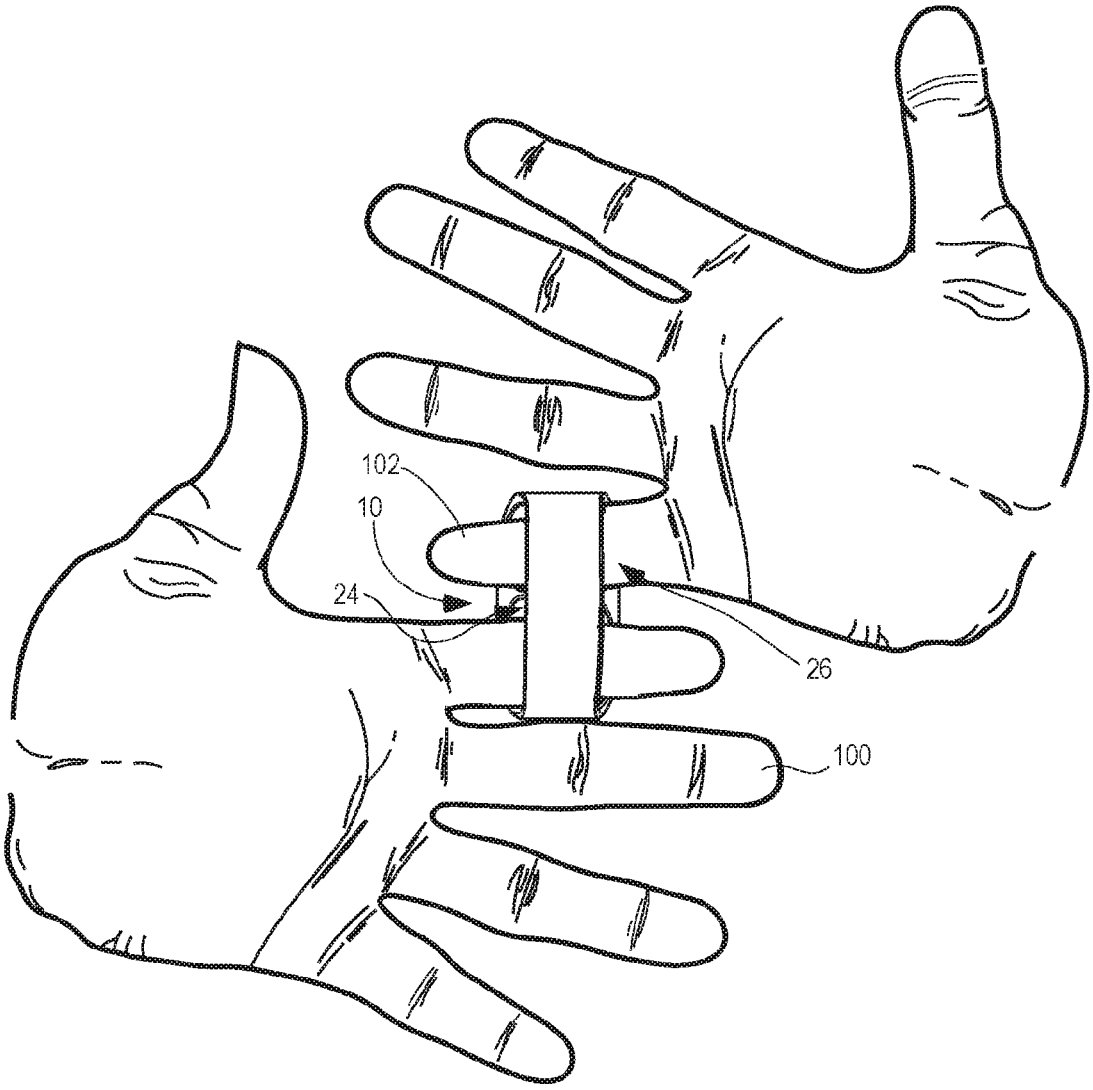
FIG. 8 is a perspective view of a grip alignment training device illustrating the positioning of the device within a user's hands in accordance with one embodiment of the present invention.

As illustrated in FIG. 8, device 10 can be used by placing the user's bottom hand index finger 100 through opening 24 until device 10 rests between the first and second knuckle of the index finger 100. Bottom sidewall region 18 of perimeter sidewall 14 preferably faces inward relative to the interior of the user's hand. The user may then place the little finger 102 of the user's top hand through opening 26 until device 10 rests between the first and second knuckle of the little finger 102, as also illustrated in FIG. 8. As illustrated in FIG. 9, the user may then grip the bat or club and device 10 can hold and maintain the user's hands together in accordance with the proper grip alignment. As further illustrated in FIG. 9, while gripping the bat or club handle 104, device 10 can prevent the second row of knuckles on the user's top hand from moving beyond the first row of knuckles of the user's bottom hand in one direction (over-grip) and beyond the second row of knuckles of the user's bottom hand in the opposite direction (under-grip). Device 10 can additionally continue to aid in this proper alignment when the user is swinging the baseball bat or golf club.

As described above, openings 24 and 26 can be configured with a generally circular cross-section and be sized to generally conform to the user's fingers. This configuration can allow the user to easily remove one or both fingers 100 or 102 from openings 24 and/or 26 upon completing a swing or when device 10 is desired to be removed. In one embodiment, opening 24 is sized and designed to fit relatively snuggly around the user's index finger 100 while opening 26 is sized and designed to fit less snuggly around the user's little finger 102 in order to allow the user to easily remove the little finger 102 from opening 26 while still allowing device 10 to remain attached to the index finger 100. Additionally, bottom sidewall region 18 can have a reduced thickness relative to top sidewall region 16 in order to allow device 10 to comfortably fit and conform with the user's hands and the bat or club handle as described above. This can allow the user to continue to have a "feel" for the bat or club handle when swinging.

Device 10 can also be adapted for accommodating the overlapping and interlocking grips for golf or other sports. In this embodiment, opening 24 can be sized and designed to receive the third finger of the user's top hand rather than the little finger. This enables the user to overlap or interlock the little finger of the top hand with the bottom hand. In such an embodiment, dividing wall 28 can be configured to provide slightly larger spacing between openings 24 and 26.

Device 10 can be constructed from any number of different materials, including but not limited to, plastic, silicone, rubber, and the like. Device 10 preferably has a semi-rigid or semi-flexible structure that allows device 10 to slightly bend and flex when used while swinging a club or bat to avoid discomfort from the user. However, device 10 also preferably maintains sufficient rigidity so that the user cannot move or rotate his or her hands out of the proper grip alignment while using device 10.

As illustrated in the figures, device 10 can be designed to be a stand-alone device. In such embodiments, device 10 can be placed directly onto the user's hands or can be used in conjunction with batting gloves or a golf glove or the like. Device 10 can also be designed in various different sizes in order to accommodate a specific user's hand size. The different sizes can also allow for the use of a batting of golf club.

According to an alternative embodiment of the present invention, device 10 can be constructed in conjunction with a batting glove (not shown). In such an embodiment, the interior sidewall surface 34 of opening 24 can be secured, permanently or semi-permanently, around the index finger of the batting glove between the first and second knuckle joints of the glove. Device 10 according to this embodiment is preferably attached to the batting glove in a vertical orientated manner to allow the user to insert the little finger of the opposite hand through opening 26 when using device 10 batting glove combination. Alternatively, device 10 can be designed with only one opening 26 where dividing wall region 28 acts as end sidewall region 20. In this embodiment, end sidewall 20 is affixed to the index finger portion of the batting glove between the first and second knuckle joints to allow the user to insert the little finger (or third finger) of the opposing hand through opening 26. When device 10 is designed with an attached batting glove, the combination can be used in the same manner as described above.

In yet another alternative embodiment, device 10 can be configured in connection with a pair of batting gloves. In this embodiment, device 10 does not comprise a main body portion 12 with openings 24 or 26 as described above, but rather comprises a set of magnets secured to specific locations on the batting glove. The magnets essentially act as the body portion 12 by using the magnetic force to provide the necessary restraint for urging the proper grip alignment of the user. In this alternative embodiment, a first magnet (not shown) is placed on the upper exterior region of the index finger portion on one glove between the first and second knuckles, and a second magnet (not shown) is placed on the lower exterior region of the little finger on the other glove between the first and second knuckles. Both the first and second magnets can be secured directly to the exterior surface of the glove or sewn or otherwise attached. Additionally, a third magnet (not shown) can be positioned on the first glove similar to the second magnet on the second glove and a fourth magnet (not shown) can be positioned on the second glove similar to the first magnet on the first glove to allow the gloves (with device 10) to be used when swinging both right and left handed.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A device for assisting a user in maintaining proper grip alignment of said user's hands when using sporting equipment, said device comprising:

a main body portion peripherally defined by a perimeter sidewall;

a first opening defined transversely through said main body portion;

a second opening defined transversely through said main body portion;

a perimeter sidewall peripherally defining said main body portion, said perimeter sidewall comprising:

a top sidewall region extending across said first and said second openings on a top side of said main body portion;

a bottom sidewall extending across said first and said second openings on a bottom side of said main body portion;

a first end region extending between said top sidewall region and said bottom sidewall region and defining a first end of said main body portion adjacent to said first opening; and a second end region extending between said top sidewall region and said bottom sidewall region and defining a second end of said main body portion adjacent to said second opening; and a dividing wall region extending inward from said perimeter sidewall and configured for separating said first opening and said second opening;

wherein each of said first and said second end regions of said perimeter sidewall include a pair of tapered edges extending between said top sidewall region and said bottom sidewall region and providing a symmetrical v-shaped configuration where a width of said end region is gradually reduced from said top sidewall region to said bottom sidewall region;

wherein said first opening is configured for receiving a first finger of a bottom hand of said user's hands and said second opening is configured for receiving a second finger of a top hand of said user's hands;

wherein said device is configured for keeping said top and said bottom hands adjacent to one another and for keeping two or more knuckles of said top and said bottom hands in a desired alignment when said user inserts said first finger through said first opening and said second finger through said second opening; and wherein said bottom sidewall region has a generally flattened shape configured to terminate adjacent to an interior of said user's hands to minimize contact with said sporting equipment when said device is in use.

2. The device of claim 1, wherein a diameter of said first opening is greater than a diameter of said second opening.

3. The device of claim 1, wherein said bottom sidewall region has a first thickness and said top sidewall portion has a second thickness, wherein said first thickness is less than said second thickness.

4. The device of claim 1, wherein said first end region and said second end region both have a generally rounded shape.

5. A training device configured for use when holding and swinging a baseball or softball bat, said device comprising:

a main body defined by a perimeter sidewall having a top sidewall region, a bottom sidewall region, and a pair of lateral end regions spanning between said top sidewall and said bottom sidewall, wherein each of said lateral end regions includes two tapered edges extending along the entire height of said lateral end regions and forming a symmetrical v-shaped configuration;

a first opening defined through said main body generally perpendicular to said top and said bottom sidewall regions;

a second opening adjacent to said first opening and defined through said main body generally perpendicular to said top and said bottom sidewall regions;

wherein said first opening has a generally circular cross-sectional shape configured for receiving an index finger of a user's bottom hand and said second opening has a generally circular cross-sectional shape configured for receiving a fourth finger of said user's top hand;

wherein said device restricts rotation of said user's bottom hand relative to said user's top hand when said user is gripping and swinging said baseball or softball bat; and wherein said bottom sidewall region has a generally flattened shape configured to terminate adjacent to an interior of said user's hands to minimize contact with the handle of said bat when said device is in use.

6. The training device of claim 5, wherein said lateral end regions have a generally rounded shape conforming to a portion of one of said first or second openings.

7. The training device of claim 5, wherein said bottom sidewall region is configured to be positioned adjacent to an interior side of said user's top and bottom hands, and wherein said bottom sidewall region has a width less than a width of said top sidewall region.

8. The training device of claim 5, wherein said device urges maintained alignment of one or more knuckles of said user's bottom hand with one or more knuckles of said user's top hand.

9. The training device of claim 5, wherein said device is attached to a batting glove at said first opening.

10. A device configured for use when holding and swinging a golf club, said device comprising:

a main body defined by a perimeter sidewall having a top sidewall region and a bottom sidewall region and end sidewall regions connecting said top and said bottom sidewall regions, wherein each of said end sidewall regions includes a pair of inwardly-angled tapered edges extending along the height of said end sidewall regions and providing said end sidewall regions with a gradually reducing width between said top sidewall region and said bottom sidewall region;

a first opening defined through said main body generally perpendicular to said top and said bottom sidewall regions;

a second opening adjacent to said first opening and defined through said main body generally perpendicular to said top and said bottom sidewall regions;

wherein said first opening has a generally circular cross-sectional shape configured for receiving an index finger of a user's bottom hand and said second opening has a generally circular cross-sectional shape configured for receiving one of a third finger and a fourth finger of said user's top hand;

wherein said device restricts rotation of said user's bottom hand relative to said user's top hand when said user is gripping and swinging said golf club; and wherein said bottom sidewall region has a generally flattened shape configured to terminate adjacent to an interior of said user's hands to minimize contact with the handle of said golf club when said device is in use.

11. The device of claim 10, wherein said device urges a maintained alignment of at least one row of knuckles of said user's top hand with at least one row of knuckles of said user's bottom hand when said user's index finger is inserted through said first opening and said user's third or fourth finger is inserted through said second opening and said user is gripping said golf club.

* * * * *